US008402710B2

(12) United States Patent
Cables

(10) Patent No.: US 8,402,710 B2
(45) Date of Patent: Mar. 26, 2013

(54) MODULAR BUILDING BLOCKS AND BUILDING BLOCK SYSTEMS

(76) Inventor: Raymond W. Cables, Fort Mill, SC (US)

( * ) Notice: Subject to any disclaimer, the term of this patent is extended or adjusted under 35 U.S.C. 154(b) by 497 days.

(21) Appl. No.: 12/566,160

(22) Filed: Sep. 24, 2009

(65) Prior Publication Data

US 2010/0095631 A1 Apr. 22, 2010

Related U.S. Application Data

(60) Provisional application No. 61/106,198, filed on Oct. 17, 2008.

(51) Int. Cl.

| | |
|---|---|
| ***E04C 3/30*** | (2006.01) |
| ***E04B 5/04*** | (2006.01) |
| ***A63F 9/08*** | (2006.01) |
| ***A63H 33/12*** | (2006.01) |
| ***A63H 33/08*** | (2006.01) |

(52) U.S. Cl. ..... 52/604; 52/574; 273/160; 446/122; 446/127

(58) Field of Classification Search ..... 52/598, 52/603, 604, 605, 606, 607, 574; 446/120, 446/122, 124, 125, 127, 128; 273/160
See application file for complete search history.

(56) References Cited

U.S. PATENT DOCUMENTS

| | | | | | |
|---|---|---|---|---|---|
| 1,567,085 | A | * | 12/1925 | Rowland | 52/605 |
| 2,392,551 | A | * | 1/1946 | Roe | 52/586.2 |
| 2,703,487 | A | * | 3/1955 | Ossoinack | 52/592.3 |
| 2,800,743 | A | * | 7/1957 | Meehan et al. | 446/127 |
| 2,861,388 | A | * | 11/1958 | Favaretto | 446/124 |
| 3,195,266 | A | * | 7/1965 | Onanian | 446/86 |
| 4,031,678 | A | | 6/1977 | Schuring | |
| 4,367,615 | A | * | 1/1983 | Feldman | 52/591.1 |
| 4,565,043 | A | | 1/1986 | Mazzarese | |
| 4,698,949 | A | * | 10/1987 | Dietrich | 52/415 |
| 4,808,140 | A | | 2/1989 | Clavet | |
| 4,833,856 | A | * | 5/1989 | Zwagerman | 52/592.1 |
| 4,932,916 | A | | 6/1990 | Blickle | |
| 5,061,219 | A | * | 10/1991 | Glickman | 446/126 |
| 5,365,714 | A | * | 11/1994 | Potvin | 52/590.2 |
| 5,465,542 | A | | 11/1995 | Terry | |
| 5,601,470 | A | | 2/1997 | Yao | |
| 5,653,621 | A | | 8/1997 | Yao | |
| 5,779,391 | A | * | 7/1998 | Knight | 405/20 |
| 5,826,394 | A | * | 10/1998 | Barton et al. | 52/592.1 |
| 6,126,506 | A | * | 10/2000 | Rudy | 446/85 |
| 6,241,248 | B1 | * | 6/2001 | Winter | 273/153 S |
| 6,379,077 | B1 | * | 4/2002 | Camber et al. | 403/367 |
| 6,450,853 | B1 | * | 9/2002 | Larws | 446/93 |
| 6,711,865 | B2 | * | 3/2004 | Chaudoreille | 52/603 |
| 6,912,819 | B2 | * | 7/2005 | Price et al. | 52/285.3 |
| 7,340,868 | B2 | * | 3/2008 | Weber | 52/586.1 |
| 8,079,195 | B2 | * | 12/2011 | Cables | 52/572 |
| 8,266,855 | B1 | * | 9/2012 | Altararwah | 52/284 |
| 2002/0043038 | A1 | * | 4/2002 | Cerrato | 52/604 |
| 2012/0135665 | A1 | * | 5/2012 | Azmani | 446/127 |

* cited by examiner

*Primary Examiner* — Joshua L Michener
*Assistant Examiner* — Ryan Kwiecinski
(74) *Attorney, Agent, or Firm* — Shumaker, Loop & Kendrick, LLP

(57) ABSTRACT

Modular building blocks and block systems including a connecting lug extending outwardly beyond the exterior surface of a block for engaging another block or block accessory, the connecting lug having a recessed slot for engaging a lug rail of a mating component, each building block further having lug rails projecting inwardly from interior surfaces of the building block accessible for engaging a recessed slot of a connecting lug of another block or block accessory, wherein a width of the first recessed slot of the building block corresponds to a width of the lug rails of the building block.

17 Claims, 11 Drawing Sheets

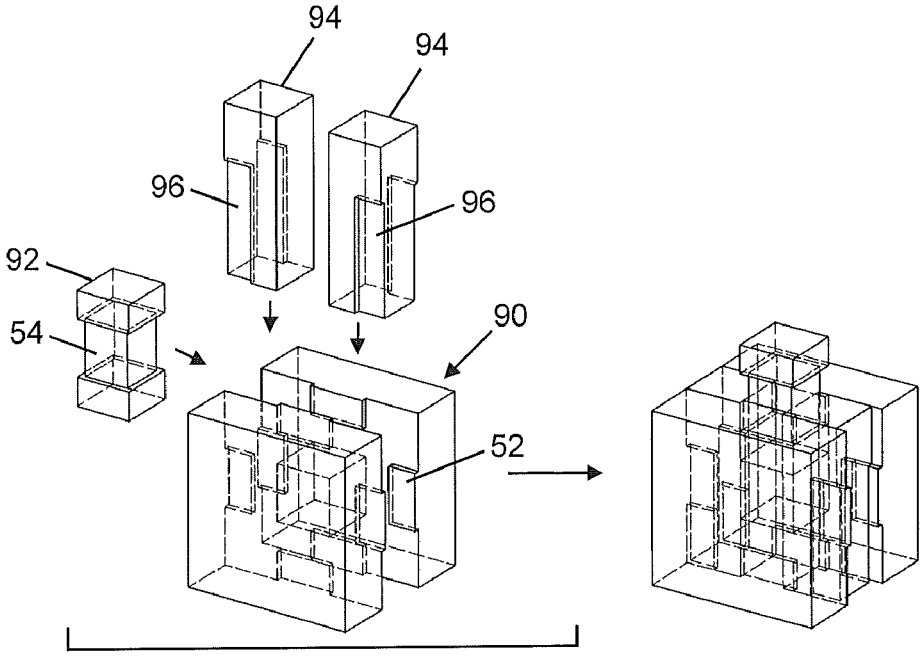
FIG. 9A
FIG. 9B
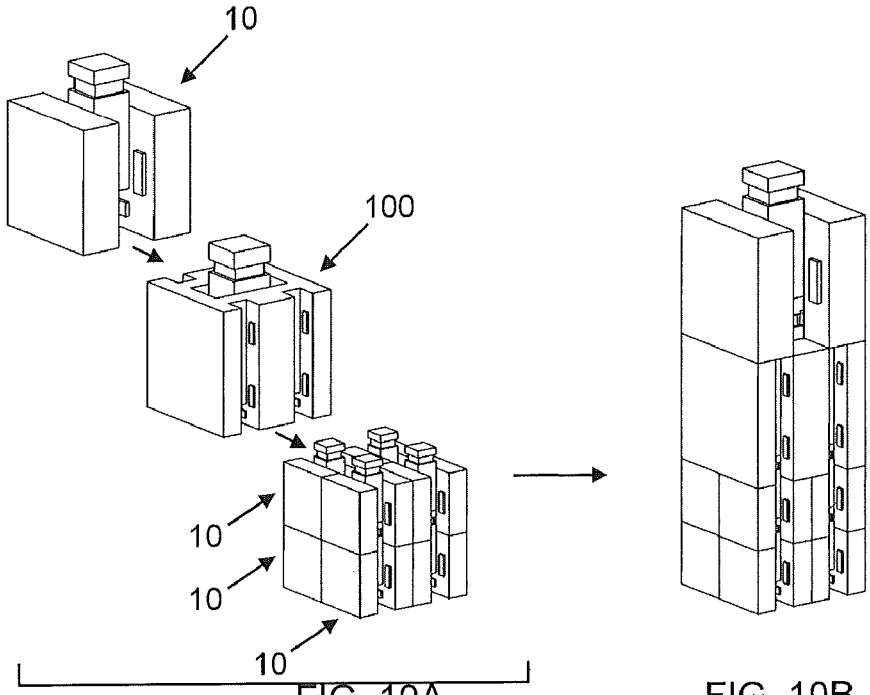
FIG. 10A
FIG. 10B

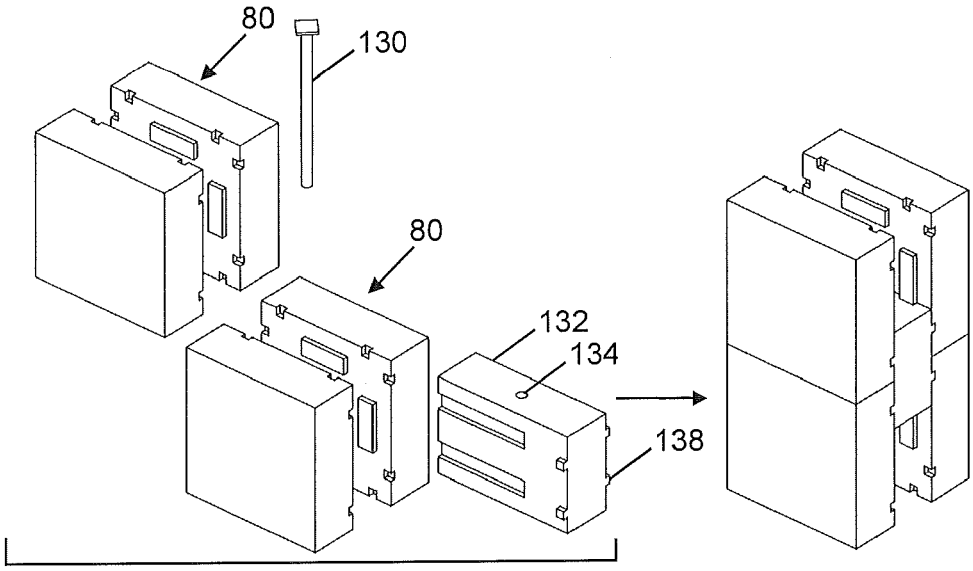
FIG. 13A
FIG. 13B
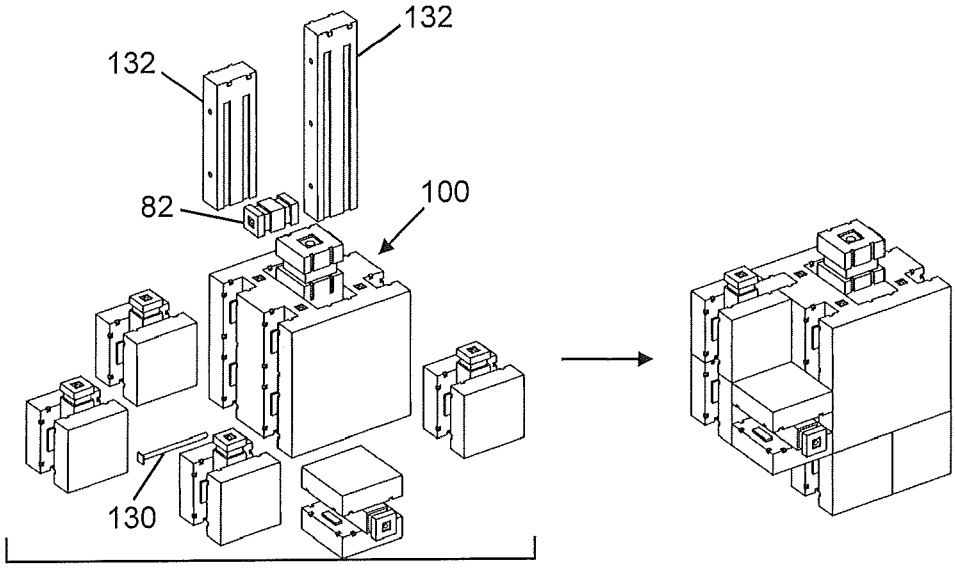
FIG. 14A
FIG. 14B

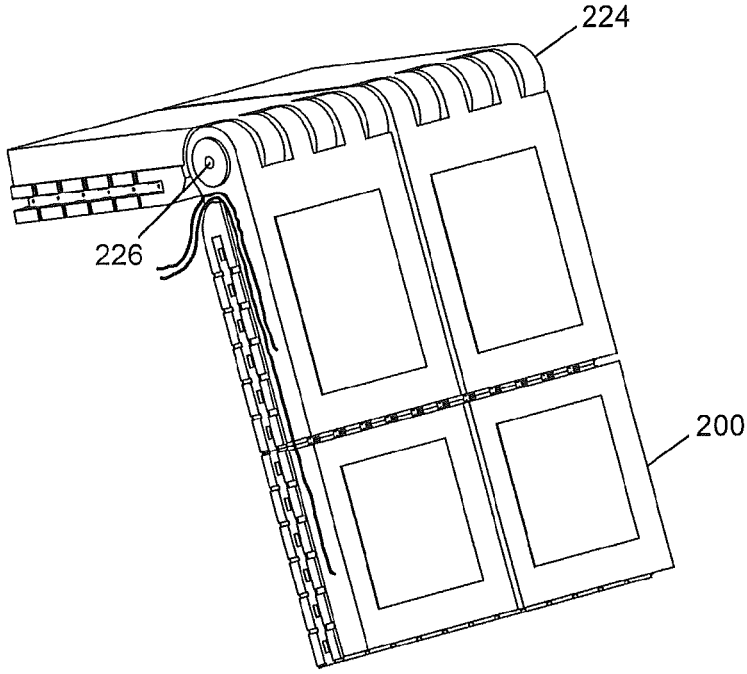
FIG. 19
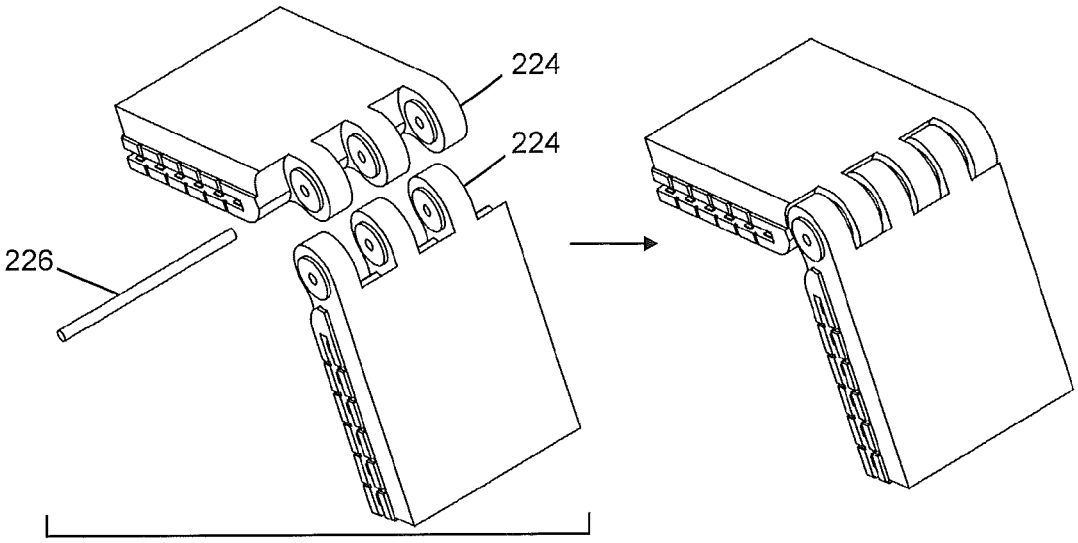
FIG. 20A
FIG. 20B

MODULAR BUILDING BLOCKS AND BUILDING BLOCK SYSTEMS

CROSS-REFERENCE TO RELATED APPLICATION

This application claims priority to U.S. Provisional Application No. 61/106,198 filed Oct. 17, 2008 and entitled "MODULAR BUILDING BLOCK SYSTEM," the contents of which are incorporated by reference herein.

TECHNICAL FIELD AND BACKGROUND OF THE INVENTION

The present invention relates generally to the field of building blocks and accessories for building structures, and more particularly, to modular building blocks and building block systems including blocks having integrated self-connecting features for connecting blocks in a variety of configurations, as well as accessories for locking blocks in engagement, filling voids defined in blocks, and interconnecting blocks of differing dimensions, among others.

Modular building systems including self-connecting features are desirable for a variety of reasons, such as their versatile connectivity and ease of on-site assembly. In contrast, conventional building blocks, such as brick and concrete block for example, must be connected using additional, independent materials such as cement, mortar, adhesives and fasteners, among others, which require time and skilled field labor to assemble. In addition, because conventional building blocks lack integrated self-connecting features, it is not possible for blocks to support other blocks in certain desirable configurations. Still further, the lack of integrated self-connecting features results in weakness at the joints between blocks when forces are applied in certain directions.

The present invention overcomes the disadvantages of conventional building blocks by providing block designs having integrated self-connecting features for interconnecting blocks in a variety of configurations and with joint strength. The systems provided herein may be readily assembled on-site with unskilled labor and without the need for additional connecting materials.

SUMMARY OF THE INVENTION

In one aspect, building blocks having integrated self-connecting features are provided herein, obviating the need for joining materials required with conventional building blocks.

In another aspect, building blocks having integrated self-connecting features are provided herein, obviating the need for time-consuming and skilled field labor for assembly.

In yet another aspect, building blocks having integrated self-connecting features are provided herein for interconnecting blocks in a variety of configurations not previously achievable with conventional building blocks.

In yet another aspect, modular building block systems are provided herein including blocks having integrated self-connecting features, and accessories for locking blocks in engagement and filling voids in blocks, among other accessories.

To achieve the foregoing and other aspects and advantages, in one embodiment a modular building block is provided having a plurality of sides and a connecting lug extending outwardly beyond an exterior surface of one of the sides of the building block for engaging a second modular building block, the connecting lug having a first recessed slot extending around the perimeter of the connecting lug and positioned intermediate the exterior surface of the block and an end of the connecting lug, the building block further having lug rails projecting inwardly from interior surfaces of the building block accessible through open sides of the building block for engaging a recessed slot of a lug of a third modular building block, wherein a width of the first recessed slot of the building block corresponds to a width of each of the lug rails of the building block.

In one embodiment, the lug rails of the building block are positioned inward relative to their respective exterior surface of the building block and function to engage the lug of a mating block to maintain the blocks together. In another embodiment, the modular building block includes lug rails positioned flush relative to their respective exterior surface of the building block in order to engage the lug of a mating block to maintain the blocks together. In an embodiment in which it is desired to have the ability to add/remove a lug, the connecting lug defines a second recessed slot extending around the perimeter of the connecting lug adjacent an opposing end of the lug, and wherein the second recess is configured to engage a lug rail of a building block to maintain the removable lug with the block.

In another embodiment, the connecting lug further includes at least one locking pin slot defined therethrough along, at least one of its longitudinal and lateral axes for receiving a locking pin, wherein locking pins function to retain rail keys and other accessories to lock blocks together and to lock accessories to the blocks. In another embodiment, further keyed engagement of blocks and accessories are provided by key slots defined in the exterior surface of the block for receiving keyed rail keys.

In yet another embodiment, a modular building block system is provided herein including first and second building blocks each having a plurality of sides and a connecting lug extending outwardly from an exterior surface of one of the sides of the building blocks for interconnecting the blocks, the connecting lug having a first recessed slot extending around the perimeter of the connecting lug positioned intermediate the exterior surface of the block and an end of the connecting lug, each of the building blocks further having lug rails projecting inwardly from interior surfaces of the building block accessible through open sides of the building blocks for engaging the recessed slot of the lug to interconnect the blocks, wherein a width of the recessed slot corresponds to a width of each of the lug rails of the blocks.

In another embodiment, the modular building block system includes rail keys having longitudinally extending lug rail channels defined therein for simultaneously receiving adjacent lug rails of the first and second building blocks to secure the blocks together, and wherein the rail keys may further include keys for engaging the exterior surface of the building blocks. In other embodiments, the system includes block fillers for filling voids in the blocks having longitudinally extending lug rail channels defined therein for receiving the lug rails of the building blocks, block caps having lug rails received between connecting lugs and lug rails, and locking pins for locking together interconnected blocks.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

These and other features, aspects and advantages of the present invention are better understood when the following detailed description of the invention is read with reference to the accompanying drawings, in which:

FIGS. 9A and 9B illustrate the assembly of a lugless block including lug rails positioned flush with the exterior of the block;

FIGS. 10A and 10B illustrate interconnecting blocks of varying scale;

FIGS. 13A and 13B illustrate block connectivity utilizing a locking pin and a keyed rail key;

FIGS. 14A and 14B illustrate versatile block connectivity utilizing locking pins and rail keys;

FIG. 19 is a perspective view of a panel assembly including multiple panels interconnected and including a hinge for providing an angle between panels;

FIGS. 20A and 20B illustrate the assembly of panels interconnected through a hinge.

DETAILED DESCRIPTION OF THE INVENTION

Figure 1A:
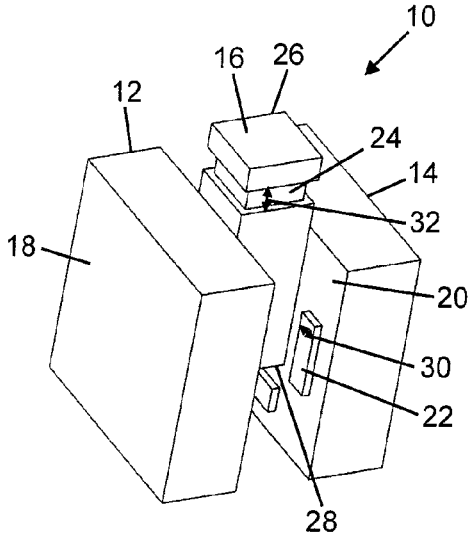
FIGS. 1A and 1B are solid and transparent perspective views, respectively, of a building block having an integrated connecting lug and lug rails positioned inward of the exterior of the block.

The present invention will now be described more fully hereinafter with reference to the accompanying drawing in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Blocks and accessories provided herein may be constructed of any material that is suited to the application for which the building system is to be used. For example, the modular building block system may be used as a toy, modeling element, or light structural element, in which case parts may be molded from materials such as plastic resin and like materials. The modular building block system may also be used for structural applications, in which case the components may be formed from materials such as concrete, wood or engineered wood materials, pressed fiber, metals, or fiber composite materials, among others. The blocks and block accessories may additionally include additives such as, but not limited to, waterproofing agents, flame retardants, colorants, etc. The blocks and accessories may be "integral" or "integrated" meaning that they are not made up of individual parts, or may be constructed from assembling individual parts to form a whole.

Referring now to the drawings, wherein identical reference numerals denote the same elements throughout the drawings, modular building blocks and modular building block systems are described with reference to specific embodiments. The modular building block systems include building blocks and accessories, as well as other components, defining features for creating secure connections between blocks in a variety of configurations. The term "block" is used throughout the specification to refer generally to a cube-shaped component, elongated cube or rectangular prism, however, it is envisioned that blocks may include alternative shapes while maintaining the features and functionality described herein. Further, the term "block" as used herein is not intended to denote any specific scale, length, width or height, and is used to refer to both single components and connected components. The term "accessory" as used herein refers to components other than blocks, such as keys, trim pieces, removable lugs, coverings, panels, panel rails, panel pins and other finishing and fastening components.

Throughout the drawings, blocks and accessories may be connected, also referred to herein as "assembled," by sliding components together. The dimensions, material, and surface finish of the blocks and accessories may be selected to provide any degree of interference fit. For example, if an easily disassembled connection is desired, a small clearance may be provided between the exterior of the lug and the lug rails. If a more permanent connection is desired, the lug may be provided with a tighter fit in the lug rails by providing an interference fit or by providing a relatively rough surface finish.

Figure 1B:
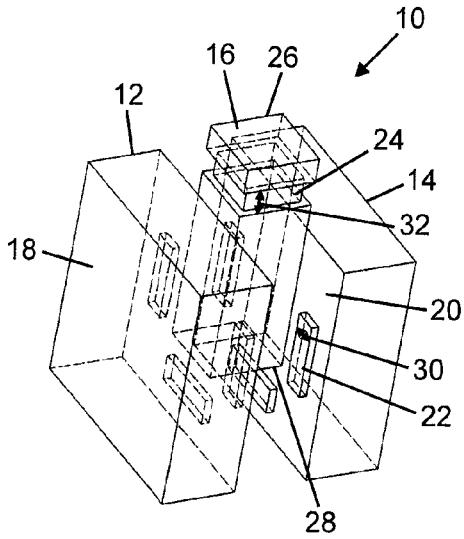

Referring to FIGS. 1A and 1B, solid and transparent views, respectively, of a first embodiment of a building block are shown at reference numeral 10. The building block 10 as shown is generally cubic in shape and defines opposing blocks 12 and 14 positioned on opposite sides of connecting lug 16, which is an integral, self-connecting feature for engaging with lug receiving features of another block to connect blocks, or with an accessory as described in detail below. The opposing blocks 12, 14 together generally define the external surface and sides of the building block 10. Each of the blocks 12, 14 define a generally planar exterior surface 18, also referred to herein as a "face", and an interior surface 20 having a plurality of lug rails 22 protruding from the surface in the direction of the interior of the building block 10. The connecting lug 16 extends outwardly beyond an exterior surface of one of the sides of the building block 10 such that it is accessible for engaging a second modular building block as described in detail below. The building block 10 is "open" on at least one of its sides such that the lug rails 22 are accessible through the sides. As shown, the building block 10 is open on three of its sides for providing access to the lug rails 22, and partially open on the side including the connecting lug 16. As shown, the connecting lug 16 is generally centered between blocks 12 and 14, and is further generally centered between the plurality of inwardly-projecting lug rails 22.

The connecting lug 16 has a recessed slot 24 or "channel" extending around the perimeter of the connecting lug and positioned intermediate the exterior surface of one of the sides of the block 10 and the end 26 of the connecting lug outside of the block. The connecting lug defines the first end 26 outside of the block, and a second end 28 positioned within the interior of the block. The connecting lug 16 has the general shape of an elongated cube. The recessed slot 24 is positioned outside of the exterior of the blocks 12, 14, and the recessed slot 24 does not extend all the way to the first end 26 of the connecting lug 16. The distance of extension of the connecting lug 16 beyond the surface defined by the blocks 12, 14 corresponds to the position of the lug rails 22 within the interior.

The building block 10 further includes at least one, and preferably multiple pairs of, lug rails 22 positioned within the interior of the block 10. The lug rails 22 in the embodiment shown are positioned completely inward with respect to the exterior surface of their respective side defined by blocks 12, 14. Thus, the lug rails 22 do not share a common side with exterior surface of the block. The lug rails 22 define a length, width and height, and the width 30 corresponds to the width 32 of the recessed slot 24. When interconnecting blocks, the recessed slot 24 of one block receives a lug rail 22 of a mating block such that the blocks are connected with their contacting exterior face flush. The height of the top portion of the connecting lug may correspond to the distance between the innermost side of the lug rail and the adjacent connecting lug surface of the mating block. As shown, three pairs of corresponding and opposing lug rails 22 are provided for engaging connecting lugs of three mating blocks.

Figure 2A:
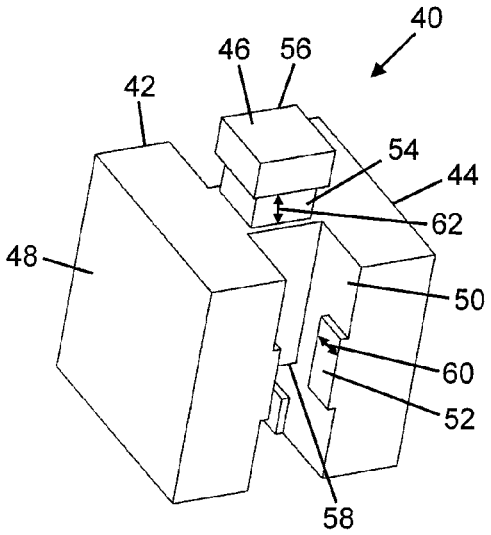
FIGS. 2A and 2B are solid and transparent views, respectively, of a building block having an integrated connecting lug and lug rails positioned flush with the exterior of the block.
Figure 2B:
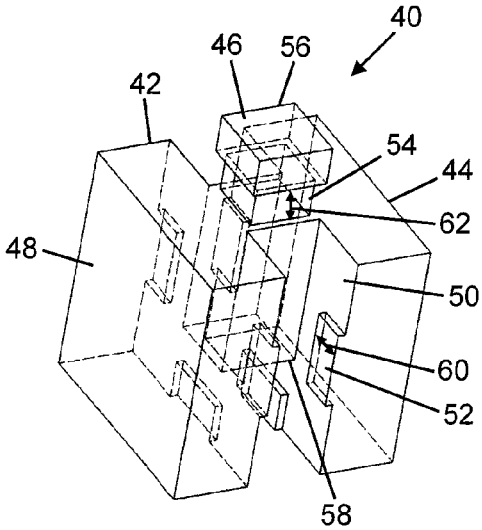
Figures 3A, 3B, 3C, 3D:
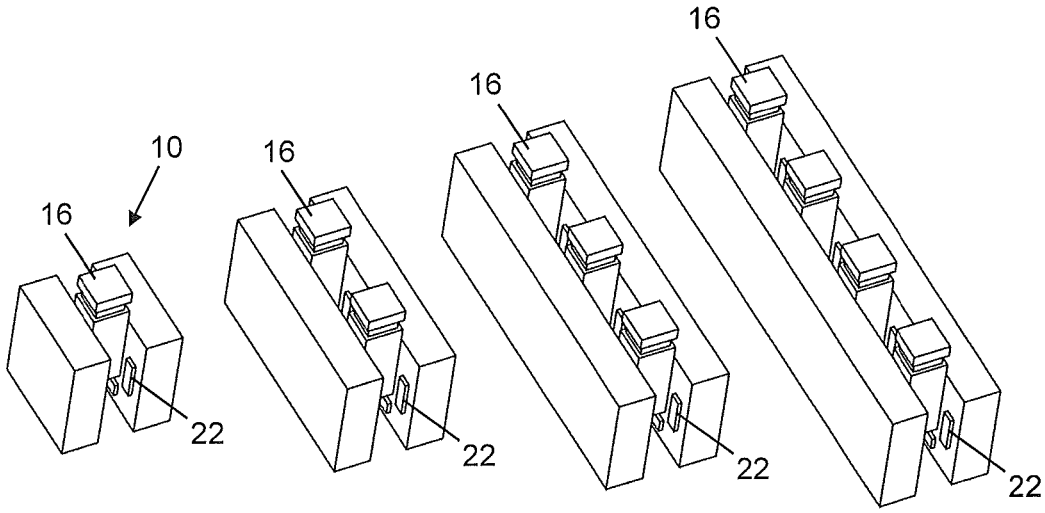
FIGS. 3A-D illustrate blocks of varying lengths.

Referring to FIGS. 2A and 2B, an alternative embodiment of a building block is shown generally at 40. As in the previous embodiment, the building block 40 is generally cubic in shape and defines opposing blocks 42 and 44 positioned on opposite sides of connecting lug 46. The opposing blocks 42, 44 together generally define the external surface and sides of the building block 40. Each of the blocks 42, 44 define a generally planar exterior surface 48, also referred to herein as a "face", and an interior surface 50 having a plurality of lug rails 52 protruding from the surface in the direction of the interior of the building block 40. The connecting lug 46 extends outwardly beyond an exterior surface of one of the sides of the building block 40 such that it is accessible for engaging a second modular building block as described in detail below.

The connecting lug 46 has a recessed slot 54 or "channel" extending around the perimeter of the connecting lug and positioned intermediate the exterior surface of one of the sides of the block 40 and the end 56 of the connecting lug outside of the block. The connecting lug further defines a second end 58 positioned within the interior of the block. The recessed slot 24 extends from the surface of the side defined by blocks 42 and 44 to short of the end 56, thus defining the lug. The pairs of lug rails 52 are positioned with one side flush with their exterior surface of the block. The lug rails 52 define a width 60 that corresponds to the width 62 of the recessed slot 54, such that a "tight" engagement is achieved when connecting blocks.

Referring to FIGS. 3A-D, variations of building block length are shown arranged in any multiple of cubes to provide any desired length, width, height, and combination thereof. The building blocks including multiple units of block 10 may be provided with or without lug rails 22 in the position between connecting lugs 16.

Figures 4A, 4B:
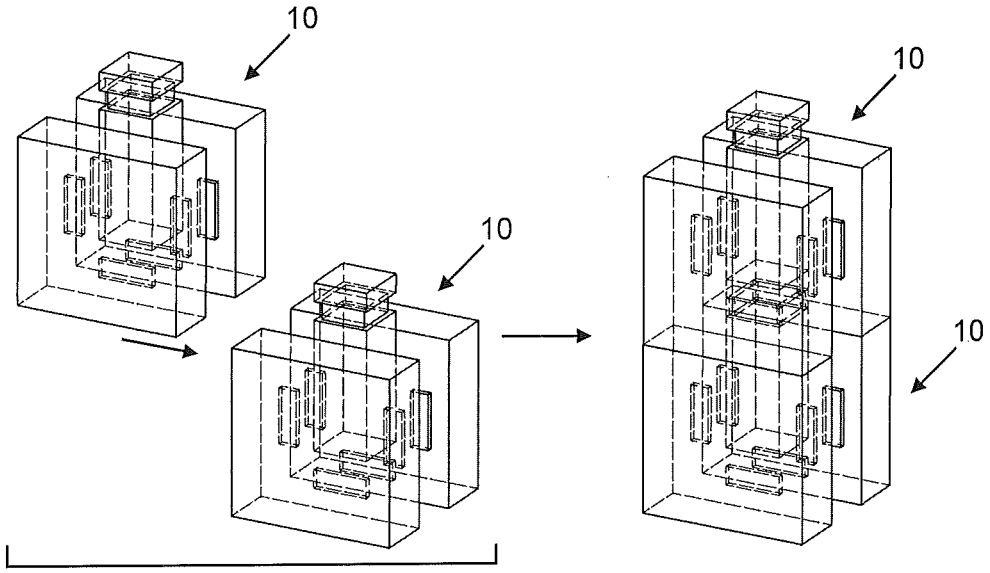
FIGS. 4A and 4B illustrate block connectivity of the block type shown in FIG. 1A.
Figures 5A, 5B:
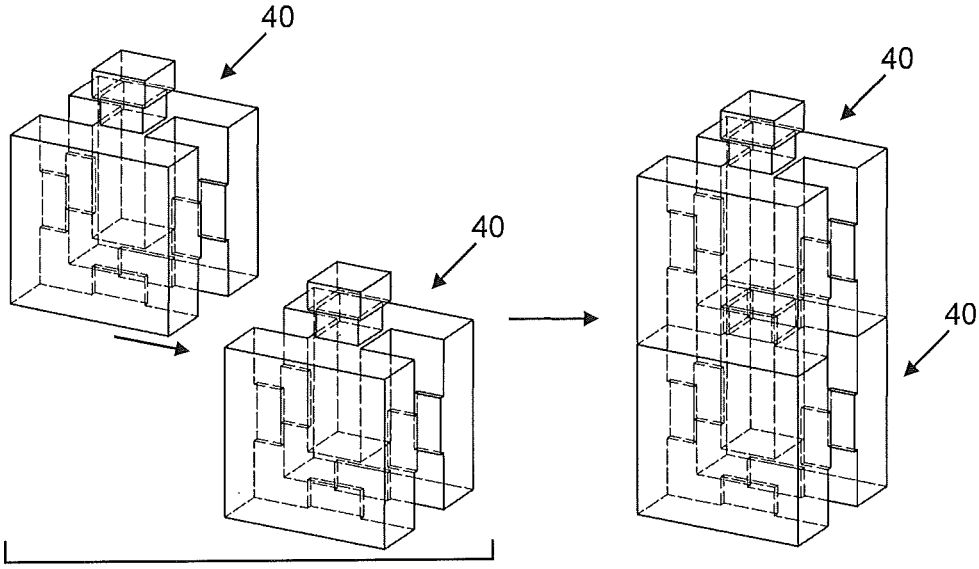
FIGS. 5A and 5B illustrate block connectivity of the block type shown in FIG. 2A.

Referring to FIGS. 4A and 4B, the interconnection of identical blocks 10 is shown. The blocks are connected by sliding one block relative to the other such that the connecting lug 16 of one block is received within the outer surface of the other block and engages the corresponding lug rails. Mating sides of the blocks 10 seat flush against one another and the engagement of the recessed slot of the lug and the lug rail prevents the blocks from being pulled apart in the vertical direction as shown. The blocks 10 are disengaged by sliding one block in the horizontal direction relative to the other as shown. Referring to FIGS. 5A and 5B, the interconnection of identical blocks 40 is shown and is performed in the same manner as that described with reference to blocks 10.

Figures 6A, 6B:
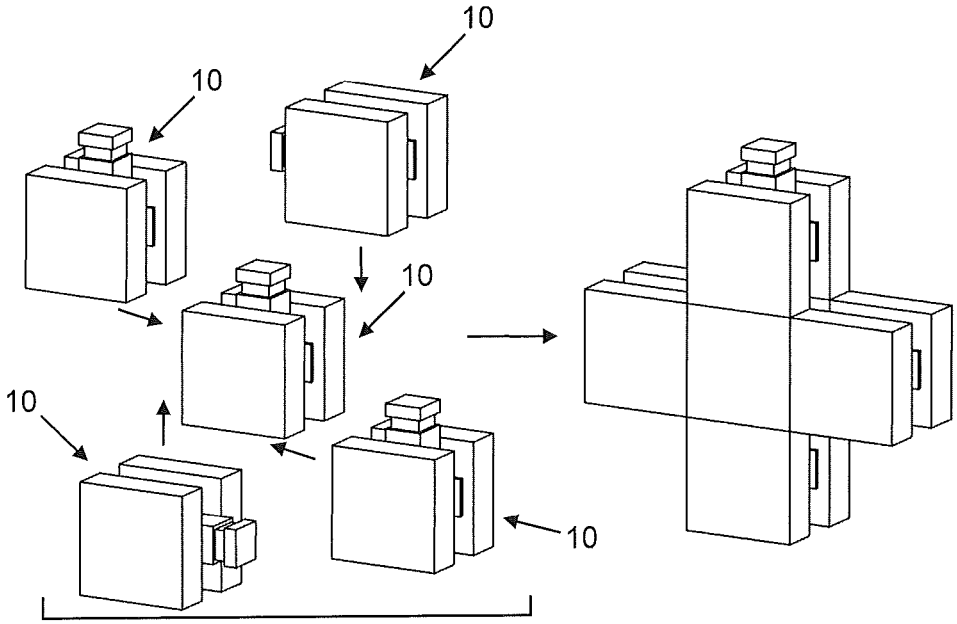
FIGS. 6A and 6B illustrate versatile block connectivity.

Referring to FIGS. 6A and 6B, the versatility of interconnectability of a plurality of blocks 10 is shown. A single block 10 including a single connecting lug 16 is configured to connect with four other blocks each having the same connecting lug and corresponding lug rail configuration. The movement of the blocks 10 relative to the center block is indicated by the directional arrows.

Figures 7A, 7B:
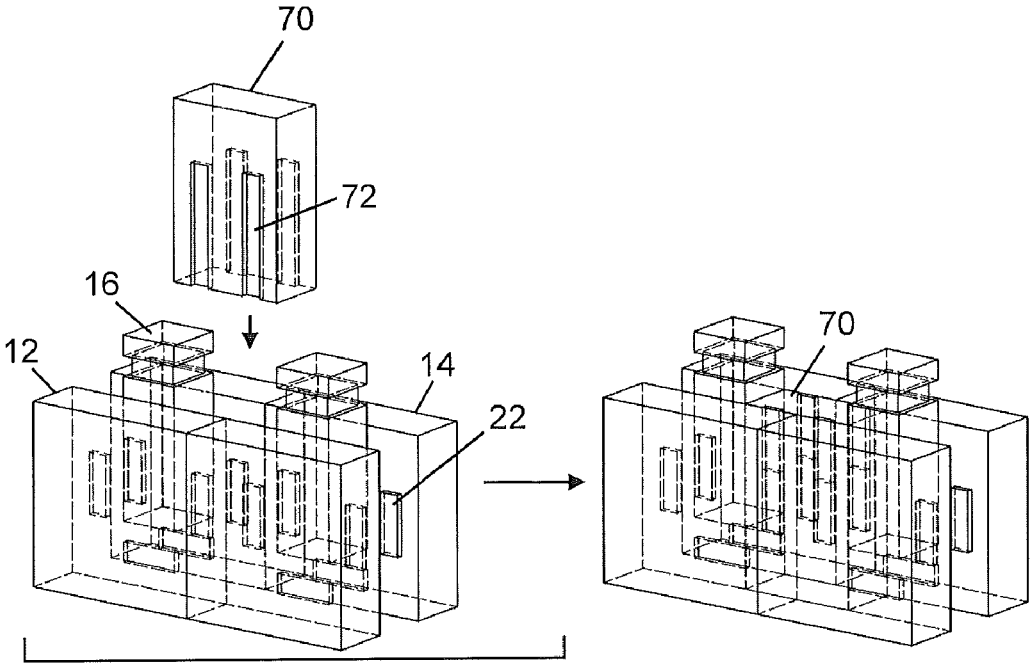
FIGS. 7A and 7B illustrate block connectivity utilizing a rail key for engaging lug rails to maintain blocks together.

Referring to FIGS. 7A and 7B, a rail key accessory 70 for connecting blocks 10 without utilizing the integrated connecting lug 16 is shown. The rail key 70 is dimensioned so that it is received in the interior of block 10 between blocks 12, 14 and does not extend beyond the exterior surface of the sides of the block when installed. The rail key 70 defines a plurality of elongate channels 72 parallel to one another and positioned on opposing sides of the rail key for receiving lug rails 22 of the blocks 10. The elongate channels 72 originate at one end of the rail key 70 and extend a predetermined distance to a position short of the opposing end of the rail key, such that a mechanical stop is provided when the lug rail 22 seats against the end of the channel 72. Thus, because the channel length does not extend the entire length of the rail key 70, the rail key cannot pass completely through the interior of the blocks, and the rail key must be removed in the direction opposite it's installation direction. In the orientation shown, the rail key's simultaneous engagement of the adjacent lug rails 22 of the blocks 10 being connected prevents a force in the horizontal direction from pulling the blocks apart. The rail key 70 may have any length for connecting any number of blocks.

Figures 8A, 8B:
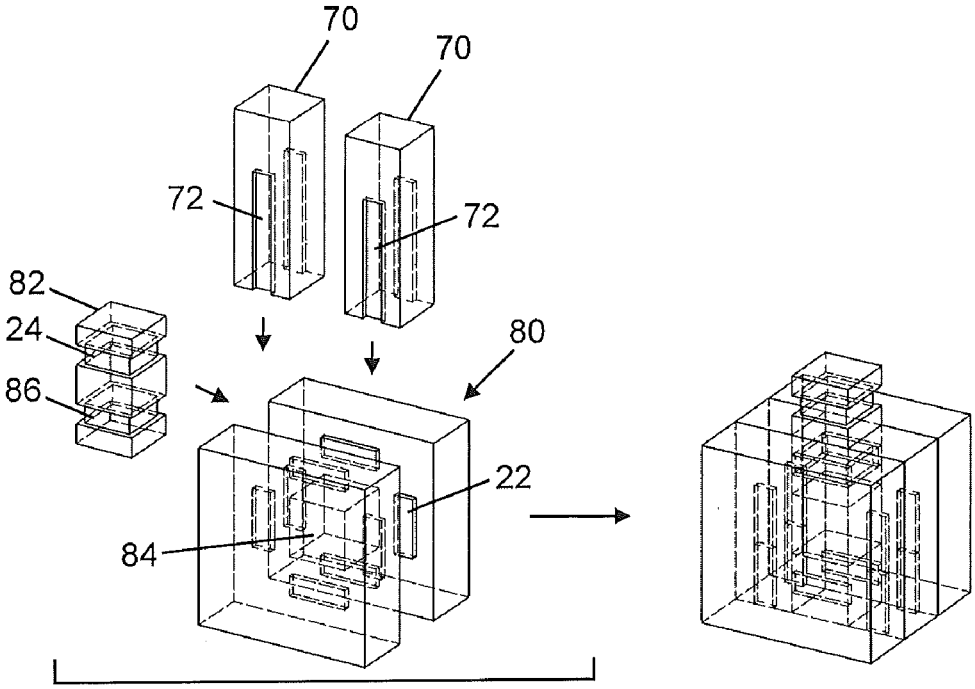
FIGS. 8A and 8B illustrate the assembly of a lugless block including lug rails positioned inward of the exterior of the block.

Referring to FIGS. 8A and 8B, a lugless block 80, corresponding connecting lug 82 and corresponding rail keys 70 are shown for constructing a lugged block. The lugless block 80 is of the lug rail-type corresponding to block 10 shown in FIG. 1A. The lugless block 80 includes four corresponding pairs of lug rails 22, each pair being positioned centered along its respective side and around a block center member 84. The lug 82 defines first and second recessed slots 24, 86 around its perimeter, wherein the first recessed slot 24 extends beyond the surface of the block and is available for engaging another block, and the second recessed slot 86 is configured for receiving one pair of lug rails 22 therein to maintain the lug 82 with the block 80. Rail keys 70 each including a single channel 72 positioned on either side of the rail key are received within the block 80 and function to maintain the installed lug 82 in place between them and partially fill the interior of the block 80. One exemplary application of the use of a lugless block 80 includes the last course of a wall.

Referring to FIGS. 9A and 9B, a lugless block 90, corresponding connecting lug 92 and corresponding rail keys 94 are shown for constructing a lugged block. The lugless block 90 is of the lug rail-type corresponding to block 40 shown in FIG. 2A. The lugless block 90 includes four corresponding pairs of lug rails 52, each pair being positioned centered along its respective side and flush with its side. The lug 92 defines a single elongate slot 54 around its perimeter and centered along its length. The slot 54 is configured for engaging both a pair of lug rails 52 of the block 90 and a pair of lug rails of a mating block. Rail keys 94 each including channels 96 positioned on either side of the rail key are received within the block 90 and function to maintain the installed lug 92 in place between them and partially fill he interior of the block 90.

Referring to FIGS. 10A and 10B, blocks of varying scale are shown being assembled. A block 10 of the type shown in FIG. 1A is shown being installed upon a block 100 having a connecting lug of similar size and multiple pairs of lug rails on three of its respective sides for engaging multiple connecting lugs of attached smaller scale blocks 10. A single block or a collection of smaller blocks may be arranged to provide a given block size. For example, if a base size block has 1 inch sides, larger sized blocks may have sides that measure 2, 4, 8, 16, 32, etc. inches, and the volume of cubes contained by each size is the cube of its side, i.e. 2 cubed is 8, 4 cubed is 64, and 8 cubed is 512, etc. Collections of smaller blocks may include a plurality of lugs or a single lug, and a single block may include a single lug or a plurality of lugs. "Enlarging blocks" may be provided for transitioning to a larger sized block, and include features that mimic the blocks beneath it. Enlarging blocks may be connected by sliding them together and may be manufactured in any multiple of cubes long, wide and high. "Reduction blocks" may be provided for transitioning to a next smaller sized block, and define a bottom portion for receiving a single lug and a top portion including a plurality of lugs for engaging with a plurality of smaller sized blocks.

Figures 11A, 11B:
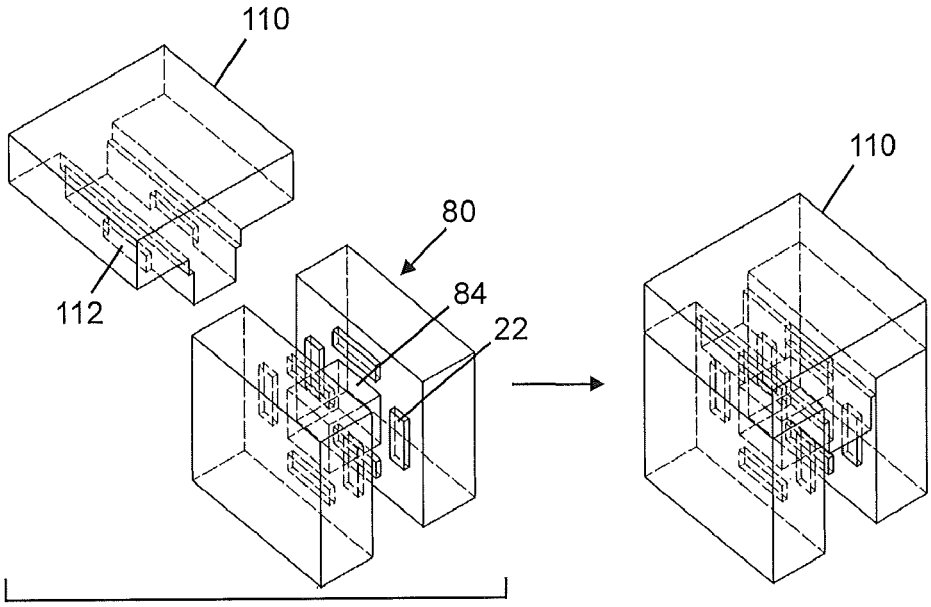
FIGS. 11A and 11B illustrate the installation of block trim.

Referring to FIGS. 11A and 11B, a capping accessory 110 is shown being assembled upon a lugless block 80 of the type shown in FIGS. 8A and 8B, however, the capping accessory 110 may be applied to a block of the type shown in FIG. 1A or include modified lug rails for engaging blocks of the type shown in FIG. 2A and FIGS. 9A and 9B. The capping accessory 110 may in one exemplary embodiment be used to cap a wall and includes lug rails 112 that engage the lug rails 22 of block 80. Specifically, the lug rails 112 are received between the space provided between the lug rail 22 and the block center member 84. The capping accessory 110 as shown increases a dimension of the block 80 to provide an elongated cube.

Other types of lugged and lugless trim may be used for covering openings and/or adding features to blocks. Trim may or may not extend beyond the surface of the sides, and may be provided in any length, width and height to cover the openings of one or more blocks. Trim having a length sufficient to simultaneously cover the openings of at least two blocks further functions to maintain the blocks together.

Figure 12:
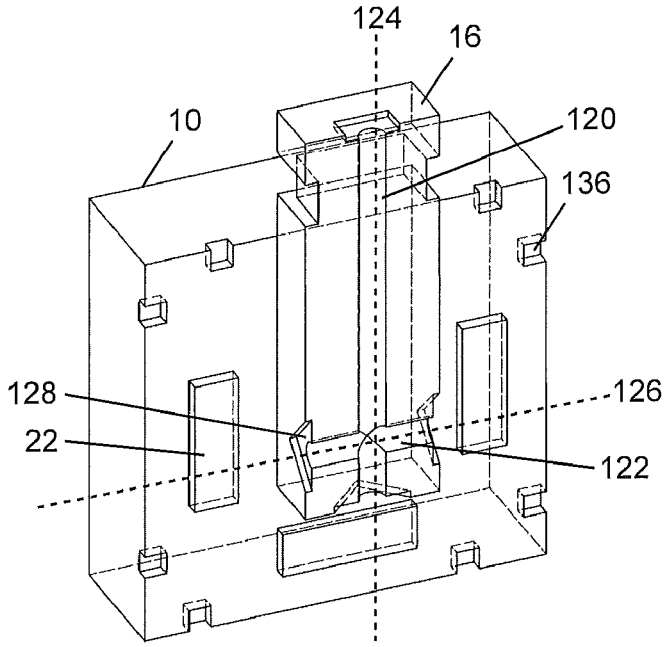
FIG. 12 is a sectional view of the block type shown in FIG. 11A illustrating pin openings defined through the connecting lug of the block for receiving locking pins.

Referring to FIG. 12, a sectional view of a block of the type shown in FIG. 1A illustrates additional block features. Specifically, the connecting lug 16 defines pin openings 120, 122 positioned along the longitudinal and lateral axes 124 and 126, respectively, of the connecting lug for receiving locking pins therethrough. The locking pins (see FIGS. 13A and 13B) function to lock blocks and accessories in engagement. As shown, the pin openings terminate in an enlarged recess 128 shaped for receiving and preventing rotation of the pinhead. The locking pinhead further functions to limit the travel of the locking pin through the opening. Although shown having a smooth bore, it is envisioned that the pin openings may be internally threaded for receiving an externally threaded fastener to provide a more secure and permanent connection. The longitudinal and lateral pins openings 120 and 122 are preferably centered along the walls in which they are arranged perpendicular thereto such that the lateral pin opening 122 may be aligned with a longitudinal pin opening of a mating block, for example. Referring to FIGS. 13A and 13B, the use of a locking pin 130 is illustrated to lock together mating, lugless connector blocks 80 and a keyed rail key 132. As shown, the locking pin 130 is received through an opening 134 defined through the rail key 132 as well as openings defined through center members (see FIGS. 8A and 8B at 84) of the mating blocks 80.

Referring to FIGS. 12 and 13A and 13B, the block 10 further defines a plurality of keyways 136 positioned around the perimeter of the interior surface 20 and adjacent the sides for receiving keys 138 carried on the rail keys 132. Referring to FIGS. 14A and 14B, the assembly of multiple embodiments of blocks, rail keys, connecting lugs and locking pins is shown to demonstrate the versatile connection possibilities of the system. As shown in FIGS. 14A and 14B, the blocks may be arranged with their planar faces either in or out of alignment.

Figure 15A:
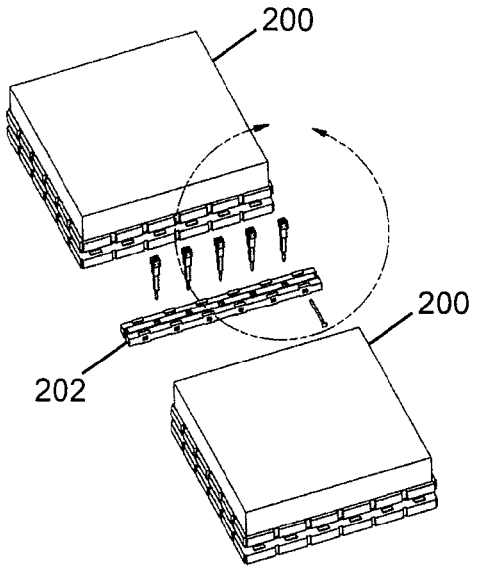
FIGS. 15A and 15B illustrate disassembled and detailed views, respectively, of panels and panel rails for interconnecting panel pieces and versatile panel connectivity.
Figure 15B:
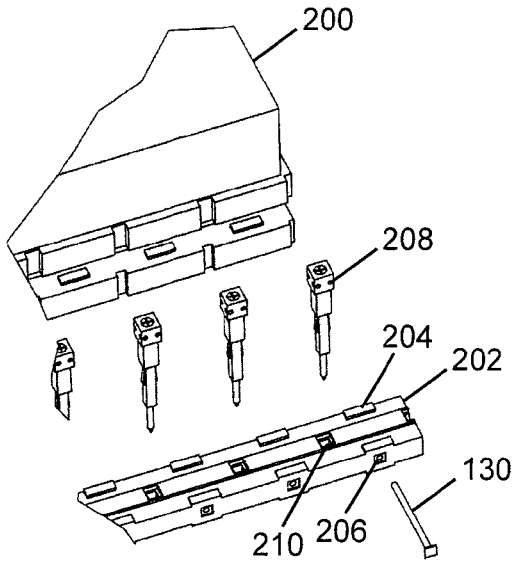
Figure 16A:
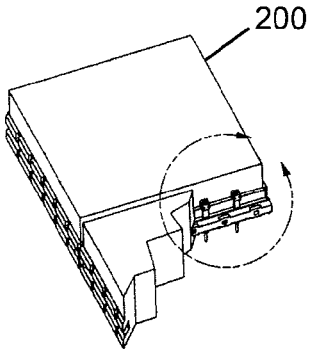
FIGS. 16A and 16B illustrate assembled and detailed views, respectively, of interconnected panels utilizing a panel rail and panel pins.
Figure 16B:
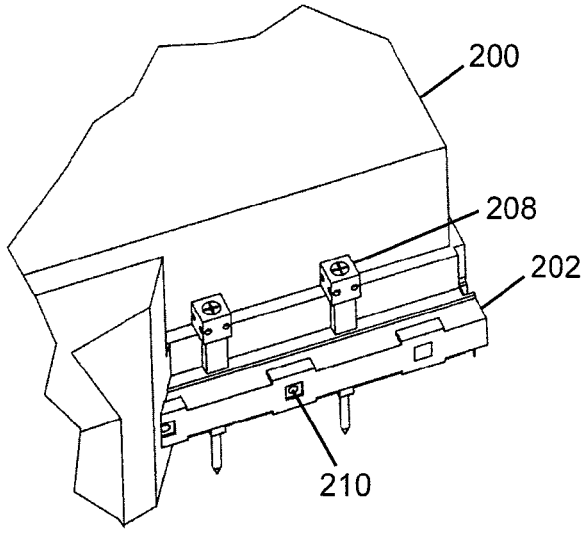

A further embodiment of the present invention provides connectable panels for supporting additional structure including, but not limited to, solar cells. Referring to FIGS. 15A-16B, panels 200 and associated panel rails 202 for interconnecting panels are shown. Panels 200 and panel rails 202 include lug rails 204 that align and retain the components together. Specifically, when properly engaged, the lug rails 204 of the panel rail 202 are received within the interior of the mating panel 200 and are aligned with the lug rails 202 of the panel, preventing the panel 200 and panel rail 202 from being pulled apart. Panels 200 and panel rails 202 are connected by sliding and engaging the components. To lock the components together and prevent them from translating, locking pins 130 received within pin openings 210 defined by both the panels 200 and panel rails 202 are provided. Pins 130 are received through aligned openings. The panel rails further define openings 206 through which fasteners are received for securing the panels to a structure, for example a roof. The fasteners shown 208 are received through the openings 206 and penetrate the roof surface as described in detail below. Referring to FIGS. 15A and 15B, the panel system is shown disassembled. Referring to FIGS. 16A and 16B, the panel system is shown assembled.

Figure 17A:
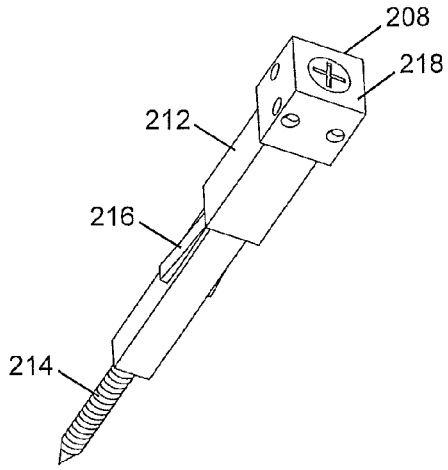
FIGS. 17A and 17B illustrate a panel pin shown activated and deactivated, respectively.
Figure 17B:
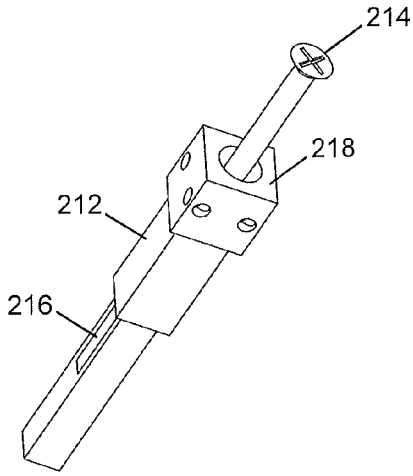

Referring to FIGS. 17A and 17B, the roof fastener 208 is shown in its activated and deactivated configurations, respectively. The roof fastener 208 includes a housing 212 defining a central bore therethrough for receiving a conventional fastener, such as a screw 214. The housing 212 has a shape other than cylindrical to prevent the housing from rotating with respect to its respective opening 206 when tightened and installed. The fastener 208 further includes hinged wings 216 positioned on either side of the housing 212 that are forced outwardly relative to the housing as the screw 214 is advanced. Specifically, the hinged wings 216 protrude into the central bore when deactivated, and are forced outwardly upon activation. The activated wings 216 contact the underside of the panel rail 202, securing the panel rail 202 between the wings 216 and the enlarged head 218 of the housing 212, thereby protecting against upward pulling forces on the panels/panel rail. The screw 214 is threaded and screwed into the roof, thereby protecting against upward pulling forces on the entire system.

Figure 18A:
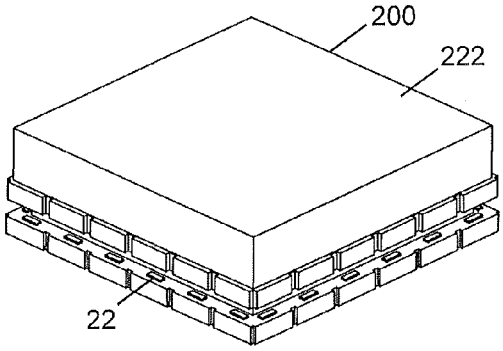
FIGS. 18A and 18B are perspective view of panels including lug rails positioned inward of the panel exterior and flush with the panel exterior, respectively.
Figure 18B:
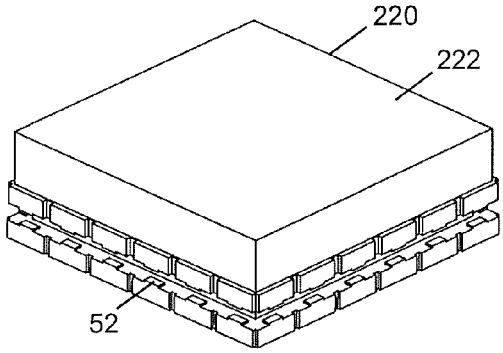

Referring to FIGS. 18A and 18B, perspective views of panels having lug rails of the types corresponding to the lug rails of FIGS. 1A and 2A, respectively, are shown. Panels 200 and 220 include a generally planar upper surface 222 for supporting a solar cell, and open sides having lug rails 22, 52 for engaging corresponding panel rails. Interconnection occurs through sliding engagement which when properly aligned prevents the panels from being pulled apart. Referring to FIGS. 19 and 20A and 20B, panels may be interconnected through a hinge 224 to provide for selective angle adjustment to conform to the angle of the underlying roof or other structure, or to position the supported solar cells at the preferred angle for optimum performance. Hinged ends of the panels interlock and are maintained together with a hinge pin 226 received through an elongate bore defined through the hinged ends.

Figures 21A, 21B:
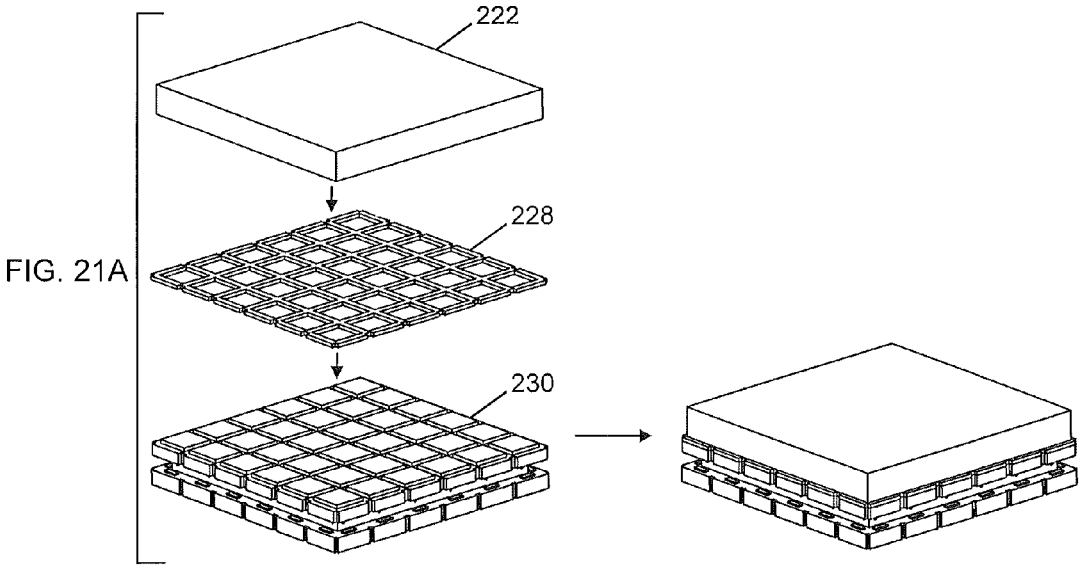
FIGS. 21A and 21B illustrate the assembly of a reinforced panel that in one embodiment serves as a support for a solar panel.

Referring to FIGS. 21A and 21B, panels, as well as blocks, may be reinforced with reinforcing structure 228 positioned between planar face 222 and connecting portion 230. Reinforcing structure 228 provides strength to the panel to support weight. Reinforcement may be added between portions of the panel or may be embedded within the panel during manufacture.

The foregoing is a description of preferred embodiments of modular building blocks and block building systems. While specific embodiments of the present invention have been described, it will be apparent to those skilled in the art that various modifications thereto can be made without departing from the spirit and scope of the invention. Accordingly, the foregoing description of the preferred embodiments of the invention and the best mode for practicing the invention are provided for the purpose of illustration only and not for the purpose of limitation.

What is claimed is:

1. A modular building block comprising two spaced apart rectangular halves that are mirror images of each other and are interconnected by a connecting lug that extends outwardly beyond a common side of the two rectangular halves for engaging another modular building block, the connecting lug having a recessed slot extending around the perimeter of the connecting lug intermediate the common side of the two rectangular halves and an end of the connecting lug, each of the two rectangular halves having three lug rails projecting inwardly towards the other of the two rectangular halves that are accessible through the space between the two halves for engaging a recessed slot of a connecting lug of another building block or accessory, wherein a width of the recessed slot corresponds to a width of each of the lug rails.

2. The modular building block according to claim 1, wherein the lug rails are positioned inward of the sides of the their respective one of the two rectangular halves.

3. The modular building block according to claim 1, wherein the lug rails are positioned flush with the sides of the their respective one of the two rectangular halves.

4. The modular building block according to claim 1, wherein the connecting lug defines a second recessed slot extending around the perimeter of the connecting lug adjacent an end of the connecting lug opposite the end adjacent the first recessed slot.

5. The modular building block according to claim 1, wherein the connecting lug further comprises at least one locking pin slot defined therethrough along at least one of a longitudinal axis and a lateral axis of the connecting lug for receiving a locking pin.

6. The modular building block according to claim 1, further comprising at least one key slot defined in the exterior surface of one of the sides of the block for receiving a key of a rail key.

7. The modular building block according to claim 1, wherein the block is generally cubic-shaped.

8. A modular building block system, comprising:

first and second building blocks each having two rectangular halves that are spaced apart and interconnected by a connecting lug that extends outwardly beyond common sides of the two rectangular halves for interconnecting the first and second building blocks, the connecting lug having a recessed slot extending around the perimeter of the connecting lug outside of the space between the two halves, each of the two rectangular halves having three lug rails projecting inwardly towards the other of the two rectangular halves that are accessible through the space between the two halves for engaging the recessed slot of the connecting lug to interconnect the first and second blocks, wherein a width of the recessed slot of the connecting lug corresponds to a width of the lug rails.

9. The modular building block system according to claim 8, further comprising a rail key having longitudinally extending lug rail channels defined therein for simultaneously receiving adjacent lug rails of the first and second building blocks to secure the blocks together.

10. The modular building block system according to claim 9, wherein the rail key includes externally projecting keys, and wherein the exterior surface of the first and second building blocks further define key slots for receiving the externally projecting keys of the rail keys.

11. The modular building block system according to claim 9, wherein the rail key has a length corresponding to the combined length of the first and second building blocks when secured together.

12. The modular building block system according to claim 8, further comprising a block filler having longitudinally extending lug rail channels defined therein for receiving the lug rails of the first building block.

13. The modular building block system according to claim 8, further comprising a block cap having a pair of lug rails projecting outwardly from exterior surfaces of the block cap that are received between a base of the connecting lug and the lug rails of the first building block.

14. The modular building block system according to claim 8, wherein the lug rails of the first and second building blocks are positioned inward of the sides of their respective one of the two rectangular halves.

15. The modular building block system according to claim 8, wherein the lug rails of the first and second building blocks are positioned flush with the sides of their respective one of the two rectangular halves.

16. The modular building block system according to claim 8, further comprising a locking pin for locking together the first and second building blocks, wherein the connecting lug of each of the first and second building blocks defines at least one locking pin slot therethrough for receiving the locking pin.

17. The modular building block system according to claim 8, wherein the locking pin is simultaneously received through both the at least one locking pin slot and a slot defined through the rail key.

* * * * *